US007985936B2

(12) United States Patent
Ahn

(10) Patent No.: US 7,985,936 B2
(45) Date of Patent: Jul. 26, 2011

(54) APPARATUS FOR INDICATING CLOSING OPERABLE STATE FOR AIR CIRCUIT BREAKER AND AIR CIRCUIT BREAKER HAVING THE SAME

(75) Inventor: Kil-Young Ahn, Daejeon (KR)

(73) Assignee: LS Industrial Systems Co., Ltd., Gyeonggi-do (KR)

( * ) Notice: Subject to any disclaimer, the term of this patent is extended or adjusted under 35 U.S.C. 154(b) by 452 days.

(21) Appl. No.: 12/164,691

(22) Filed: Jun. 30, 2008

(65) Prior Publication Data

US 2009/0014300 A1 Jan. 15, 2009

(30) Foreign Application Priority Data

Jul. 12, 2007 (KR) ..... 10-2007-0070270

(51) Int. Cl.
*H01H 9/16* (2006.01)

(52) U.S. Cl. ..... 200/308; 200/400

(58) Field of Classification Search ..... 200/400, 200/401, 500, 501, 293, 573, 574, 303, 307, 200/308, 337

See application file for complete search history.

(56) References Cited

U.S. PATENT DOCUMENTS

| | | | | |
|---|---|---|---|---|
| 4,409,449 | A | 10/1983 | Takano et al. | |
| 4,475,021 | A * | 10/1984 | Mochizuki et al. | 200/400 |
| 4,529,951 | A | 7/1985 | Youichi et al. | |
| 4,760,226 | A * | 7/1988 | Fasano | 200/303 |
| 5,140,115 | A * | 8/1992 | Morris | 200/308 |
| 5,418,343 | A | 5/1995 | Faber et al. | |
| 5,485,134 | A * | 1/1996 | Seymour et al. | 335/132 |
| 5,936,535 | A * | 8/1999 | Rosen et al. | 340/638 |
| 5,986,225 | A * | 11/1999 | Castonguay et al. | 200/308 |
| 6,166,343 | A * | 12/2000 | Blessitt et al. | 200/400 |
| 6,242,703 | B1 * | 6/2001 | Castonguay et al. | 200/308 |
| 6,788,172 | B1 * | 9/2004 | Godesa et al. | 335/17 |
| 2008/0087534 | A1 | 4/2008 | Yang et al. | |
| 2008/0088395 | A1 | 4/2008 | Seo | |
| 2008/0088396 | A1 | 4/2008 | Ahn et al. | |

(Continued)

FOREIGN PATENT DOCUMENTS

EP 0362846 4/1990

(Continued)

OTHER PUBLICATIONS

English language Abstract of RU 2006111708, Aug. 27, 2006.

(Continued)

*Primary Examiner* — Michael A Friedhofer

(74) *Attorney, Agent, or Firm* — Greenblum & Bernstein P.L.C.

(57) ABSTRACT

Disclosed is an apparatus for indicating a closing operable state for an air circuit breaker and an air circuit breaker having the same. The apparatus for indicating a closing operable state for the air circuit breaker comprises a micro switch installed at a switching mechanism providing a driving force for switching contactors, provided with a lever extended into the switching mechanism so as to receive the driving force, generating and outputting an electric signal for indicating that the air circuit breaker is in a closing operable state, and provided with a signal transmitting terminal for transmitting the electric signal to a remote place, and an on coupling pressing the lever of the micro switch so that the micro switch generates and outputs the electric signal only when a closing spring for providing elastic energy for switching the contactors charges elastic energy and the air circuit breaker is opened.

10 Claims, 8 Drawing Sheets

U.S. PATENT DOCUMENTS

| | | | |
|---|---|---|---|
| 2008/0122563 | A1 | 5/2008 | Song |
| 2008/0157906 | A1 | 7/2008 | Oh |

FOREIGN PATENT DOCUMENTS

| | | |
|---|---|---|
| FR | 2699324 | 6/1994 |
| JP | 55-108118 | 8/1980 |
| JP | 5-128943 | 5/1993 |
| JP | 7-130251 | 5/1995 |
| JP | 7-335061 | 12/1995 |
| JP | 10-199377 | 7/1998 |
| JP | 2001-143578 | 5/2001 |
| JP | 2009-21249 | 1/2009 |
| RU | 2257636 | 7/2005 |
| RU | 2006111708 | 8/2006 |

OTHER PUBLICATIONS

English language Abstract of RU 2257636, Jul. 27, 2005.
U.S. Appl. No. 12/144,793 to Lyu, filed Jun. 24, 2008.
U.S. Appl. No. 12/146,702 to Park, filed Jun. 26, 2008.
U.S. Appl. No. 12/147,698 to Yang, filed Jun. 27, 2008.
U.S. Appl. No. 12/163,002 to Sohn, filed Jun. 27, 2008.
U.S. Appl. No. 12/164,296 to Ahn, filed Jun. 30, 2008.
U.S. Appl. No. 12/165,789 to Kim et al., filed Jul. 1, 2008.

* cited by examiner

APPARATUS FOR INDICATING CLOSING OPERABLE STATE FOR AIR CIRCUIT BREAKER AND AIR CIRCUIT BREAKER HAVING THE SAME

BACKGROUND OF THE INVENTION

1. Field of the Invention

The present invention relates to an air circuit breaker, more particularly, to an apparatus for indicating a closing operable state for an air circuit breaker which is capable of informing a user located at a remote place from the air circuit breaker or a door of a power distributing cage that the air circuit breaker is in a closing operable state and an air circuit breaker having the same.

2. Description of the Related Art

An air circuit breaker can be operated in a state that contactors for conducting or closing a circuit are connected to each other by a switching mechanism, i.e., on state. That is, the switching mechanism of the air circuit breaker can exist in four states, namely, a first state that the contactors are separated (opened) from each other, i.e., off state, and a closing spring is elastically charged, a second state that the contactors are separated from each other and the closing spring is elastically discharged, a third state that the contactors are contacted (connected) with each other and the closing spring is elastically charged, and a fourth state that the contactors are contacted with each other and the closing spring is elastically discharged. The switching mechanism of the air circuit breaker can perform a closing operation only in the first state that the contactors are separated from each other, i.e., off state, and the closing spring is elastically charged.

The four states of the switching mechanism of the air circuit breaker will be described with reference to accompanying drawings.

It will be described with reference to FIG. 1 that is a state view showing that a general air circuit breaker is opened and the closing spring is elastically discharged.

A switching apparatus of the air circuit breaker shown in FIG. 1 includes a switching mechanism 10, a movable contactor moved to a closing position or an opening position by the switching mechanism 10, and an upper terminal 34*a* as a stationary contactor corresponding to the movable contactor. Though a connection portion of a lower terminal 34*b* is not shown, the lower terminal 34*b* is always connected to the movable contactor mechanically and electrically.

In FIG. 1, a reference numeral 11 designates the closing spring. The closing spring has one end provided with a spring seat coming into contact with a drive lever 16 and is compressed by the drive lever 16, thus charges elastic energy.

A reference numeral 12 designates a cam. The cam can be rotated electrically or manually through a cam shaft that does not have a reference numeral. The cam 12 provides the drive lever 16 with pressure varied according to an outer circumferential surface by coming into contact with a drive lever roller 19 installed at the drive lever 16 so that the drive lever 16 elastically charges the closing spring 11.

A reference numeral 13 designates a closing latch. The closing latch serves to maintain the closing spring 11 in the elastically charged state. To this end, the closing latch 13 is locked by an on lever 14.

A reference numeral 17 designates an on coupling. The on coupling serves to rotatingly move the on lever 14 to a released position of the closing latch 13 by being pressed by a closing button (not shown) or a closing solenoid for an automatic closing manipulation.

A reference numeral 15 designates a link mechanism. When discharging elastically charged elastic energy by the closing spring 11, the link mechanism can be rotated in a counterclockwise direction in FIG. 1 by coming into contact with the drive lever 16 and pressed thereby. And the link mechanism can drive a lever 31 in a closing direction by being connected thereto.

A reference numeral 18 designates a main shaft stopper restricting a rotation of the lever 31 and a main shaft 30 by being installed at one position on a rotational path of the lever 31.

A reference numeral 21 designates an opening spring providing the main shaft 30, a switching shaft, with rotational energy in an opening direction when the switching mechanism 10 is opened manually or automatically, namely, performs a trip operation. A reference numeral 22 designates an open latch locking the opening spring 21 to maintain its state charging elastic energy. Here, only an open lever 23 coming into contact with the open latch 22 to be locked or released can perform the locking operation.

A reference numeral 32 designates a connecting link transmitting a switching driving force from the lever 31 to a movable contactor 33 by being connected between the lever 31 and the movable contactor 33.

The reference numeral 33 designates the movable contactor. And, an upper terminal 34*a* corresponding to a stationary contactor is fixedly installed facing the movable contactor with being spaced therefrom by a predetermined distance.

FIG. 1 is the state view showing that the air circuit breaker is opened and the closing spring is elastically discharged. The air circuit breaker in the closed state as shown in FIG. 3 is changed into the opened state as shown in FIG. 1 by a manual manipulation, for example, by pressing an off button (not shown) which makes the open lever 23 rotated by interlocking. Also, the air circuit breaker may be automatically changed into the opened state as shown in FIG. 1 by an over current trip relay (abbreviated to OCR) generating and outputting a trip controlling signal by monitoring a fault current conducted state of a circuit and an actuator providing a mechanical trigger signal pressing the open lever 23 by responding to the trip controlling signal.

When the open lever 23 is rotated manually or automatically in the closed state as shown in FIG. 3, the open latch 22 locked by the open lever 23 is released, thereby releasing the lever 31 from a locked state. Thus, the opening spring 21 discharges elastic energy, namely, the opening spring 21 is restored into its original state from a tensioned state, accordingly the lever 31 connected to the opening spring 21 is rotated together with the main shaft 30 in the counterclockwise direction. Then, the movable contactor 33 connected to the lever 31 through the connecting link 32 is moved backwardly, namely, moved rightwardly on FIG. 1, accordingly the movable contactor 33 is separated from the upper terminal 34*a* corresponding to the stationary contactor, thereby breaking the circuit, as shown in FIG. 1.

FIG. 2 is a state view showing that the general air circuit breaker is opened and the closing spring is elastically charged. In the drawing, the air circuit breaker is changed into the opened state such as FIG. 1, and then the closing spring is elastically charged.

Since the process that the air circuit breaker is changed into the opened state from the closed state is described with reference to FIG. 1, thus it will be omitted. And, an elastically charging operation of the closing spring will be described hereafter.

When a cam shaft of the cam is rotated in manual by using a charging handle (not shown) disposed at the front surface of the air circuit breaker or in automatic by using an additional motor (not shown), the drive lever 16 is rotated in a clockwise direction on the drawing by the drive lever roller 19 coming into contact with the outer circumferential surface of the cam. Thus, the closing spring 11 connected to one end of the driver lever 16 is compressed through the spring seat, thereby charging elastic energy. FIG. 2 shows a state that the charging of the closing spring is completed while the air circuit breaker is in the opened state.

FIG. 3 is a state view showing the general air circuit breaker is closed and the closing spring is elastically discharged, which can be implemented when the air circuit breaker is opened as shown in FIG. 2 and the closing spring is changed into the elastically discharged state from the elastically charged state. Thus, when the on coupling 17 is moved rightwardly in the state shown in FIG. 2 in manual by using an on button (not shown) or in automatic by using the closing solenoid (not shown), the on lever 14 is rotated in the clockwise direction by pressing of the on coupling 17. Accordingly, the closing latch 13 being locked by the on lever 14 is released and then the closing spring 11 maintained in the elastically charged state by the closing latch 13 discharges elastic energy. Then, by the discharged elastic energy, the drive lever 16 is rotated in the counterclockwise direction, accordingly the link mechanism 15 connected to the drive lever 16 rotates the lever 31 and the main shaft 30 in the clockwise direction. Thus, the movable contactor 33 pressed leftwardly on the drawing, namely, toward the stationary contactor through the connecting link 32 is moved leftwardly in FIG. 2 and then comes into contact with the upper terminal 34*a* corresponding to the stationary contactor as shown in FIG. 3. Here, a closed circuit is formed electrically, thereby conducting a current on the circuit.

FIG. 4 is a state view showing that the general air circuit breaker is closed and the closing spring is charged, which shows that the air circuit breaker is closed as shown in FIG. 3 and then the closing spring is charged. A process that the air circuit breaker is closed and the closing spring is charged is same as the aforementioned description, thus will be omitted.

FIG. 5 is a perspective view entirely showing an appearance of an on coupling of the air circuit breaker in accordance with the related art. As shown in FIG. 5, the on coupling 60 of the air circuit breaker in the related art which is the same part designated as reference numeral 17 on FIG. 1-4 includes an on lever contacting part 60*b* serving as an operation part and disposed at the front surface (left side on the drawing) so as to rotate the on lever 14 by pressing the same, and a bias spring suspender 60*a* disposed at a central upper portion in a length direction. Here, the bias spring suspender 60*a* for supterminaling (i.e. engaging) one end of a bias spring 62 (refer to FIG. 9) providing an elastic force for moving the on coupling 60 to the front surface of the air circuit breaker.

In the related art, there are no means to inform a state that the air circuit breaker is in a closing operable state. Thus, generally, the air circuit breaker is mechanically configured so that the closing operation cannot be allowed in a state that the contactors are contacted with each other and the closing spring is charged as shown in FIG. 4. However, a user doesn't know this characteristic of the air circuit breaker may instruct the closing operation by pressing the closing button. In this case, since the closing operation is not performed, the user may misunderstand that the air circuit breaker is out of order.

Thus, it is required to inform the user that the air circuit breaker is in the closing operable state, and when the user is located at a remote place from the air circuit breaker or the air circuit breaker is mounted in a power distributing cage, it is required to install an apparatus for indicating the closing operable state at an outer door of the power distributing cage so as to inform whether or not the air circuit breaker is in the closing operable state.

SUMMARY OF THE INVENTION

Therefore, the present invention is directed to an apparatus for indicating a closing operable state for an air circuit breaker which is capable of informing that the air circuit breaker is in the closing operable state when the air circuit breaker is located at a remote place or mounted in a power distributing cage, and an air circuit breaker having the same.

To achieve these and other advantages and in accordance with the purpose of the present invention, as embodied and broadly described herein, there is provided an apparatus for indicating a closing operable state for an air circuit breaker comprises a micro switch installed at a switching mechanism providing a driving force for switching contactors, provided with a lever extended into the switching mechanism so as to receive the driving force, generating and outputting an electric signal for indicating that the air circuit breaker is in a closing operable state, and provided with a signal transmitting terminal for transmitting the electric signal to a remote place; and an on coupling pressing the lever of the micro switch so that the micro switch generates and outputs the electric signal only when a closing spring for providing elastic energy for switching the contactors charges elastic energy and the air circuit breaker is opened.

And, there is provided an air circuit breaker having an apparatus for indicating a closing operable state comprising a stationary contactor connected to a circuit, a movable contactor that can be moved to a closing position for conducting the circuit by coming into contact with the stationary contactor or an opening position for disconnecting the circuit by being separated from the stationary contactor, a closing spring providing a driving force for moving the movable contactor to the closing position when discharging charged elastic energy, a switching mechanism transmitting the discharging energy of the closing spring to the movable contactor, a closing latch that can be moved to a locking position for locking the switching mechanism so as to maintain the closing spring in the elastically charged state or a releasing position for releasing the switching mechanism so as to discharge the charged elastic energy, an on lever rotationally driven by coming into contact with the closing latch so as to move the closing latch to the releasing position, a closing button for manually instructing a closing operation, and an on coupling driven by coming into contact with the closing button so as to rotate the on lever. Here, the apparatus for indicating the closing operable state comprises a micro switch installed on a moving path of the on coupling moving to a position where it comes into contact with the on lever and indicating that the air circuit breaker is in the closing operable state with a lever coming into contact with the on coupling moving to the position where it comes into contact with the on lever when the closing spring charges elastic energy and the movable contactor is opened, and a switch operation part installed at the on coupling so as to allow the lever of the micro switch to be pressed so that the micro switch generates and outputs an electric signal when the closing spring charges elastic energy and the movable contactor is opened.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Figure 1:
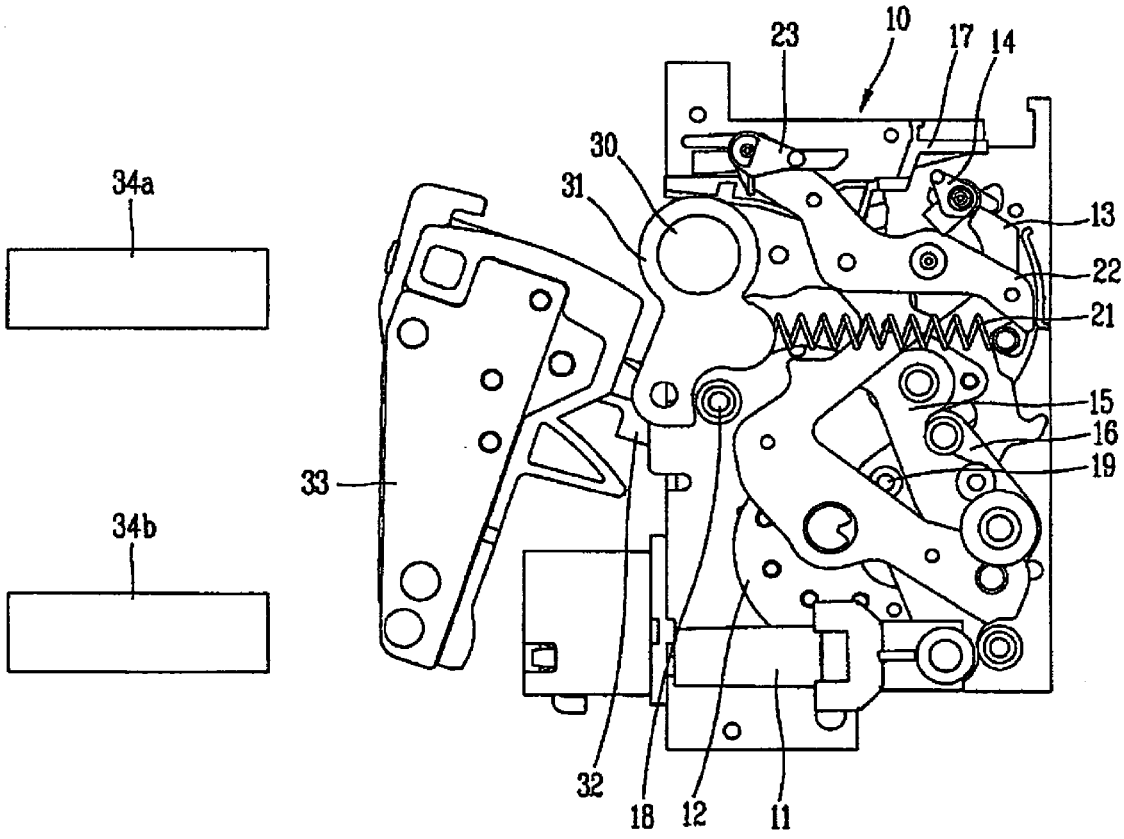
FIG. 1 is a state view showing that a general air circuit breaker is opened and a closing spring is elastically discharged.
Figure 2:
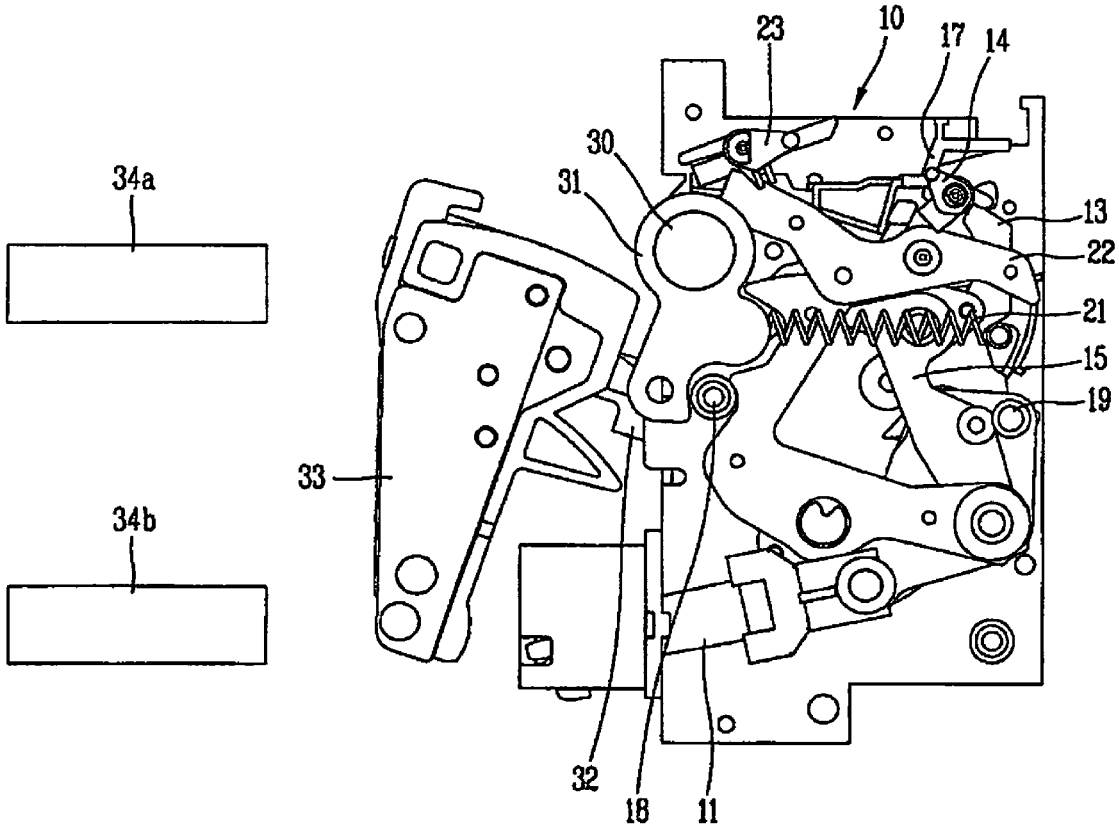
FIG. 2 is a state view showing that the general air circuit breaker is opened and the closing spring is elastically charged.
Figure 3:
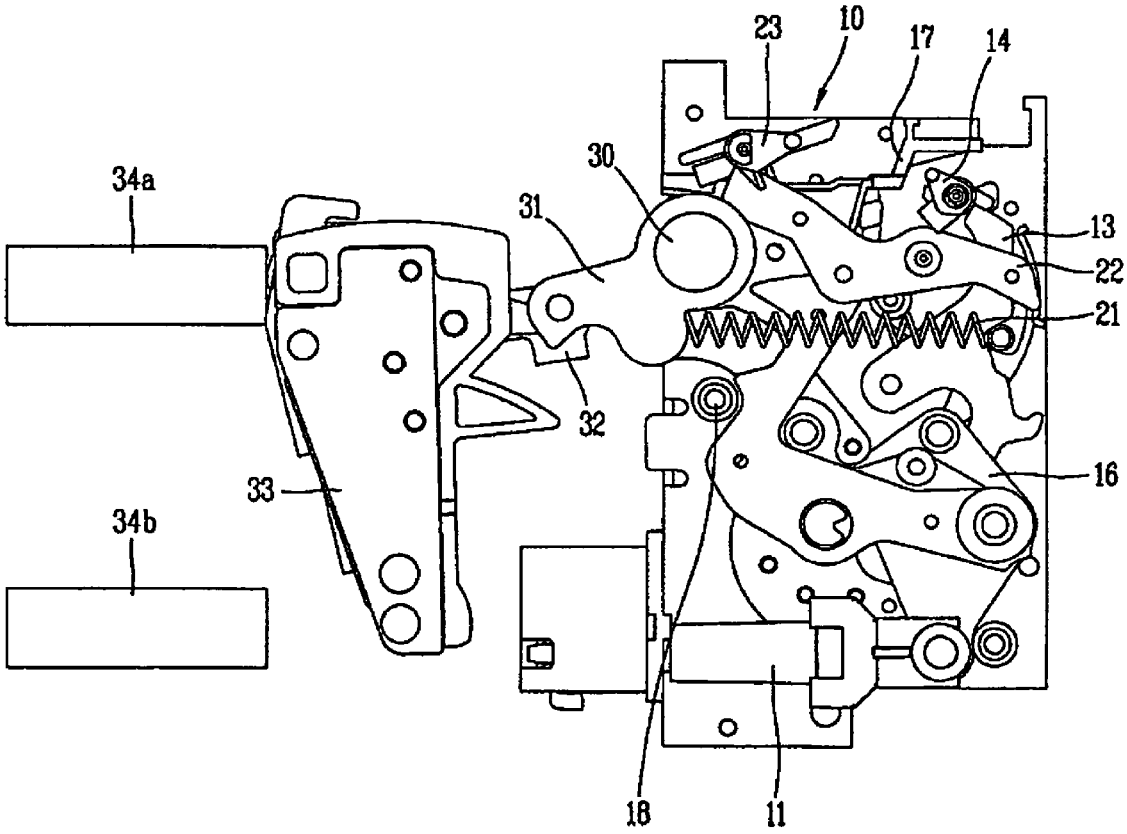
FIG. 3 is a state view showing that the general air circuit breaker is closed and the closing spring is elastically discharged.

Description will now be given in detail of the preferred embodiments of the present invention, examples of which are illustrated in the accompanying drawings.

An apparatus for indicating a closing operable state for an air circuit breaker in accordance with the present invention will be described with reference to FIGS. 6 to 10.

As shown in FIGS. 6 to 10, the apparatus for indicating the closing operable state for the air circuit breaker includes a micro switch 72 and the on coupling 60. The micro switch 72 is installed on the switching mechanism 10 of the air circuit breaker 1 providing a driving force for switching contactors. In order to receive a switching operation force, the micro switch 72 is provided with a lever 71 extended into the switching mechanism 10. And, in order to generate and output an electric signal indicating that the air circuit breaker 1 is in the closing operable state and transmit the electric signal to a remote place, the micro switch 72 is provided with signal transmitting terminals 75*a*, 75*b*.

In the air circuit breaker 1, only when the closing spring 11 providing elastic energy for switching the contactors charges elastic energy and the air circuit breaker 1 is opened, a switch operation part 61 is installed to face the lever 71 of the micro switch 72 so as for the micro switch 72 to generate and output the electric signal and for the on coupling 60 to press the lever 71 of the micro switch 72.

Figure 7:
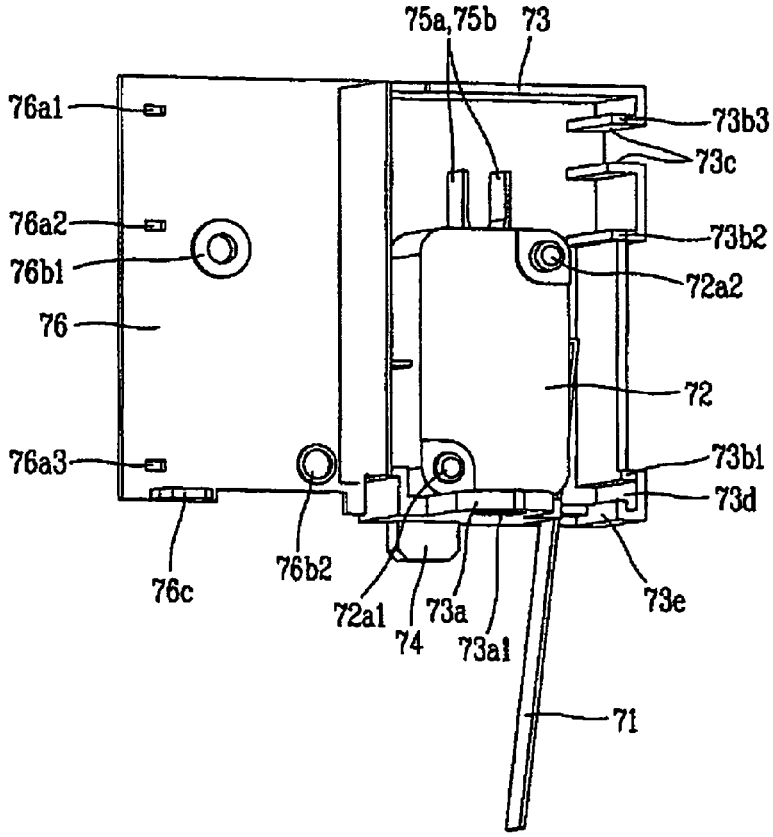
FIG. 7 is a perspective view showing each configuration of a micro switch and a switch case mounting the micro switch therein as main components of an apparatus for indicating a closing operable state for an air circuit breaker in accordance with the present invention.
Figure 8:
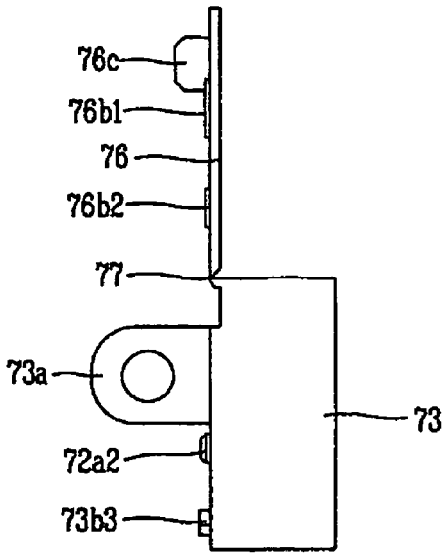
FIG. 8 is a top view showing the switch case of FIG. 7 when a door is opened.

As shown in FIGS. 7 and 8, the apparatus for indicating the closing operable state for the air circuit breaker is formed by an electrically insulating material and further includes a switch case mounting the micro switch 72 therein.

The switch case includes a case main body 73 having one opened surface, mounting the micro switch 72 therein and fixable to the switching mechanism 10, and a door 76 by which the opened surface of the case main body 73 can be opened or closed.

Further, the switch case is provided with a locking mechanism 73*b*1-73*b*3, 76*a*1-76*a*3, 76*c*, 73*d* at the door 76 and the case main body 73 corresponding to the door 76 so that the door 76 can maintain its closed state.

The locking mechanism 73*b*1-73*b*3, 76*a*1-76*a*3, 76*c*, 73*d* is composed of locking protrusions 73*b*1-73*b*3, 76*c* and a locking groove 73*d* or locking openings 76*a*1-76*a*3 into which the locking protrusions 73*b*1-73*b*3, 76*c* are inserted. Here, the locking protrusions may be disposed at the door 76 and the locking groove or the locking openings may be disposed at the case main body 73, and vice versa.

In accordance with one embodiment, the locking protrusions 73*b*1-73*b*3, 76*c* include the locking protrusions 73*b*1-73*b*3 disposed to correspond to the locking openings 76*a*1-76*a*3 formed at three positions, i.e., upper, middle and lower positions, adjacent to an opposite side of a hinge of the door 76, and the lower locking protrusion 76*c* disposed at an lower end of the door 76.

The micro switch 72 is provided with two screw insertion holes in a diagonal direction at two of upper and lower positions. Each fixing screw is inserted into the two screw insertion holes so as to fix the micro switch 72 to the case main body 73. Here, reference numerals 72*a*1 and 72*a*2 designate heads of upper and lower fixing screws.

In order to insert the fixing screw even when the door 76 is closed, upper and lower fixing screw insertions holes 76*b*1, 76*b*2 allowing the fixing screws to be inserted thereinto are provided at the door 76.

As shown in FIG. 8, the door 76 and the case main body 73 are connected to each other by a chamfer 77 having a thickness thinner than other portion of the switch case and serving as a hinge portion for rotatably opening or closing the door 76.

Figure 9:
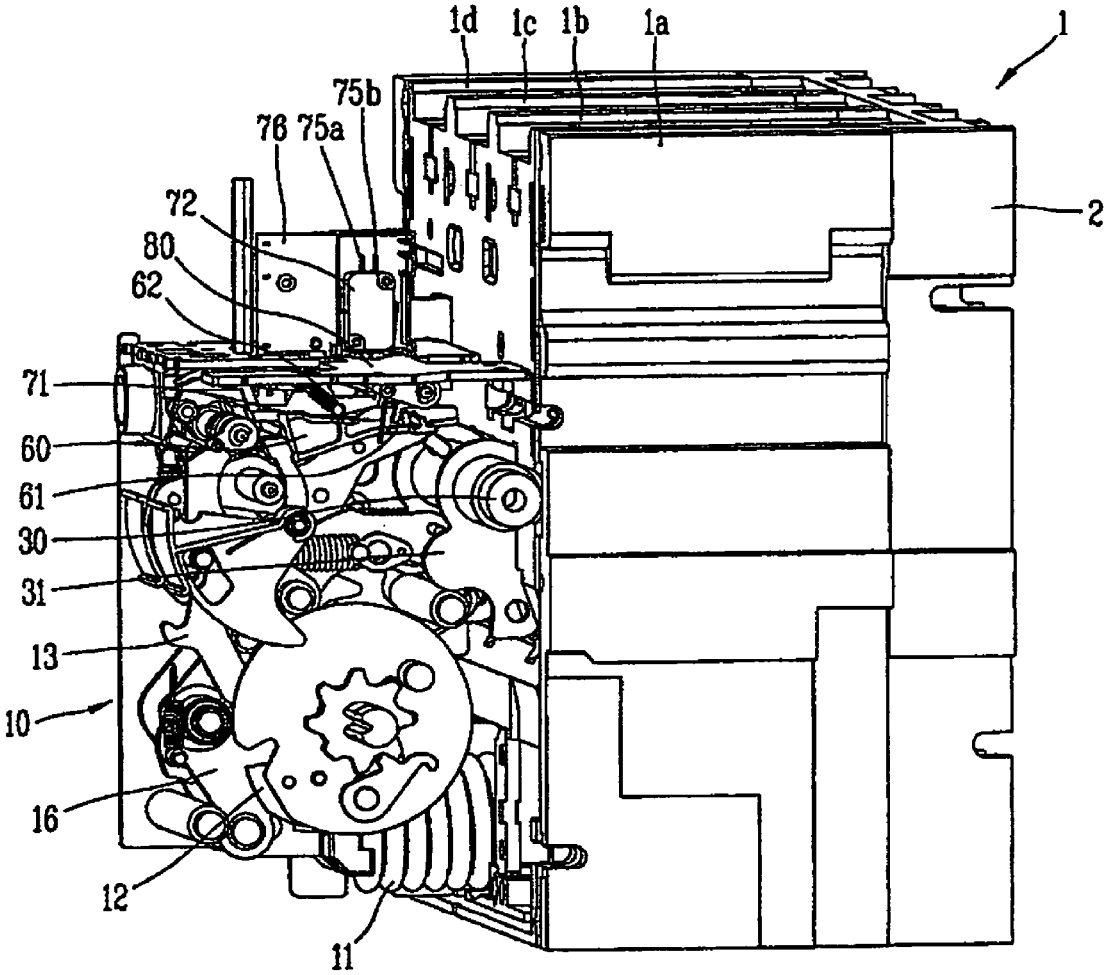
FIG. 9 is a perspective view showing a configuration of an apparatus for indicating a closing operable state for an air circuit breaker and an air circuit breaker having the same in accordance with the present invention.
Figure 10:
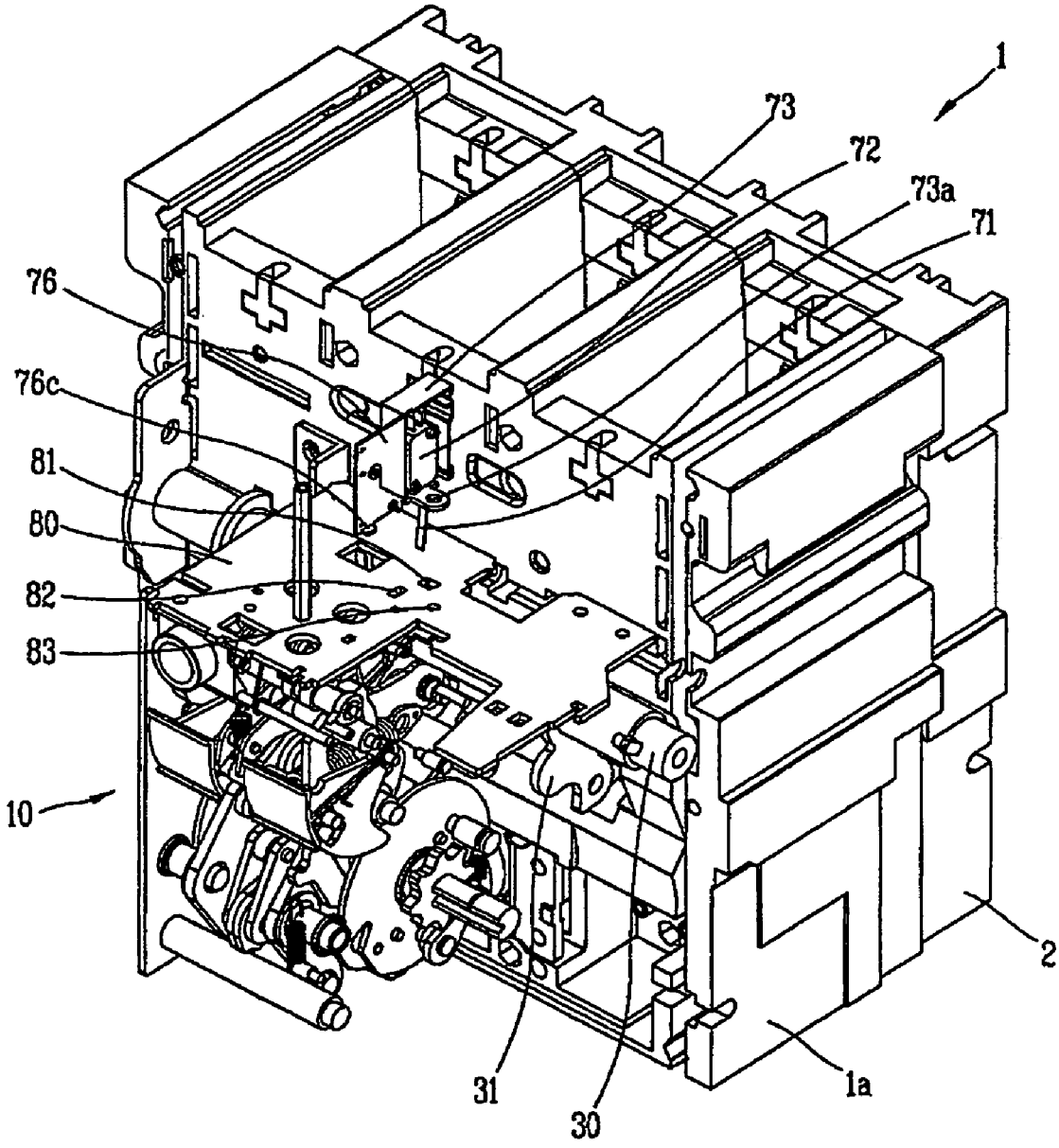
FIG. 10 is a perspective view showing a configuration to fixedly install the apparatus for indicating a closing operable state for an air circuit breaker of FIG. 9 onto a top plate of a switching mechanism of an air circuit breaker.

Also, as shown in FIG. 7, the case main body 73 includes a insertion fixing protrusion 74 downwardly extended from a lower surface of the case main body 73 and a screw fixing protrusion 73*a* horizontally extended from the lower side of the case main body 73, so as to fix the switch case to the switching mechanism (refer to a reference numeral 10 of FIGS. 9 and 10). A screw hole 73*a*1 is provided at a middle portion of the screw fixing protrusion 73*a*.

And, the case main body 73 includes an opening wall for a lever 73*e* allowing the lever 71 of the micro switch 72 to be outwardly protruded even when the door 76 is closed, and an opening wall for introducing a signal wire 73*c* allowing the signal wire (not shown) connected to signal transmitting terminals 75*a*, 75*b* of the micro switch 72 to be introduced thereinto.

FIG. 8 is a top view showing the switch case of FIG. 7 when the door 76 is opened.

Referring to FIG. 8, it can be seen how much the locking mechanism and the screw fixing protrusion 73*a* are protruded and how they are relatively positioned on the horizontal direction.

Meanwhile, referring to FIGS. 9 and 10, a configuration and an operation of the air circuit breaker 1 having the apparatus for indicating the closing operable state in accordance with the present invention will be described.

The air circuit breaker 1 includes the stationary contactor connected to the circuit and the movable contactor that can be moved to a closing position for conducting the circuit by coming into contact with the stationary contactor or an opening position for disconnecting the circuit by being separated from the stationary contactor.

The stationary contactor and the movable contactor are generally disclosed for the air circuit breaker, thus additional drawings and description about the contactors will be omitted. In FIGS. 9 and 10, the stationary contactor is fixedly installed on a rear common insulating wall 2 between insulating partition walls laid adjacent to each other, and the movable contactor is movably installed between the insulating partition walls 1*a*-1*d* adjacent to each other.

The air circuit breaker 1 includes the closing spring 11 providing the movable contactor with the driving force for moving the closing position when discharging the charged elastic energy, the switching mechanism 10 transmitting the discharged energy of the closing spring 11 to the movable contactor, the closing latch 13, the on lever (not shown, refer to the reference number 14 in FIG. 4), a closing button (not shown), and the on coupling 60.

In order to maintain the closing spring 11 in the elastically charged state, the closing latch 13 can be moved to a locking position for locking the switching mechanism 10 or a releasing position for releasing the switching mechanism so as to discharge the charged elastic energy of the closing spring.

The on lever (not shown, refer to the reference numeral 14 in FIG. 4) may be rotatably driven to allow the closing latch 13 to be moved to the releasing position by coming into contact with the closing latch 13.

The closing button (not shown) serves to manually instruct the closing operation.

The on coupling 60 coming into contact with the closing button can be driven to rotate the on lever.

The air circuit breaker in accordance with the present invention includes the micro switch 72 and the switch operation part 61 installed at the on coupling 60 as characteristic components. The micro switch 72 is installed on a moving path of the on coupling 60 moving to a position for coming into contact with the on lever (not shown, refer to the reference numeral 14 in FIG. 4). When the closing spring 11 charges the elastic energy and the movable contactor is opened, the micro switch 72 is provided with a lever 71 coming into contact with the on coupling 60 moving to the position for coming into contact with the on lever. Also, the micro switch 72 generates and outputs an electric signal for indicating that the air circuit breaker is in the closing operable state.

When the closing spring 11 charges the elastic energy and the movable contactor is opened, the on coupling 60 is provided with the switch operation part 61 pressing the lever 71 of the micro switch 72, the lever 71 allowing the micro switch 72 to generate and output the electric signal.

As shown in FIG. 9, the switch operation part 61 is installed at a position facing the lever 71 of the micro switch 72 and protruded by a pressed distance of the lever 71 of the micro switch 72 long enough to operate the micro switch 72. That is, the switch operation part 61 is protruded toward the lever 71 of the micro switch 72 from the on coupling 60 by a predetermined distance long enough to move the lever 71 of the micro switch 72 so as to generate the electric signal transmitting that the air circuit breaker is in the closing operable state resulting from that inner electric contactors of the micro switch 72 are opened or closed.

The air circuit breaker in accordance with the present invention further includes the switch case installed on an top plate 80 of the switching mechanism 10 by being formed by an electric insulating material, mounting the micro switch 72 therein and provided with the door 76 that can be opened or closed.

Since the configuration of the switch case shown in FIGS. 9 and 10 is described with reference to FIGS. 7 and 8, thus will be omitted.

In FIG. 10, an unexplained reference numeral 81 indicates a lever insertion hole into which the lever 71 of the micro switch 72 disposed on the top plate 80 of the switching mechanism 10 can be inserted. A reference numeral 82 indicates a lower locking protrusion insertion hole into which the lower locking protrusion 74 disposed at the lower surface of the case main body 73 of the switch case is inserted so as to allowing the switch case to fix onto the top plate 80 of the switching mechanism 10. A reference numeral 83 indicates a screw insertion hole portion into which the fixing screw is inserted so as to fix the switch case by being communicated with the screw insertion hole 73*a*1 of the screw fixing protrusion 73*a* horizontally extended from the lower surface of the case main body 73.

Hereafter, an operation of the apparatus for indicating the closing operable state for the air circuit breaker and the air circuit breaker having the same in accordance with the present invention will be described with reference to FIG. 9.

Figure 4:
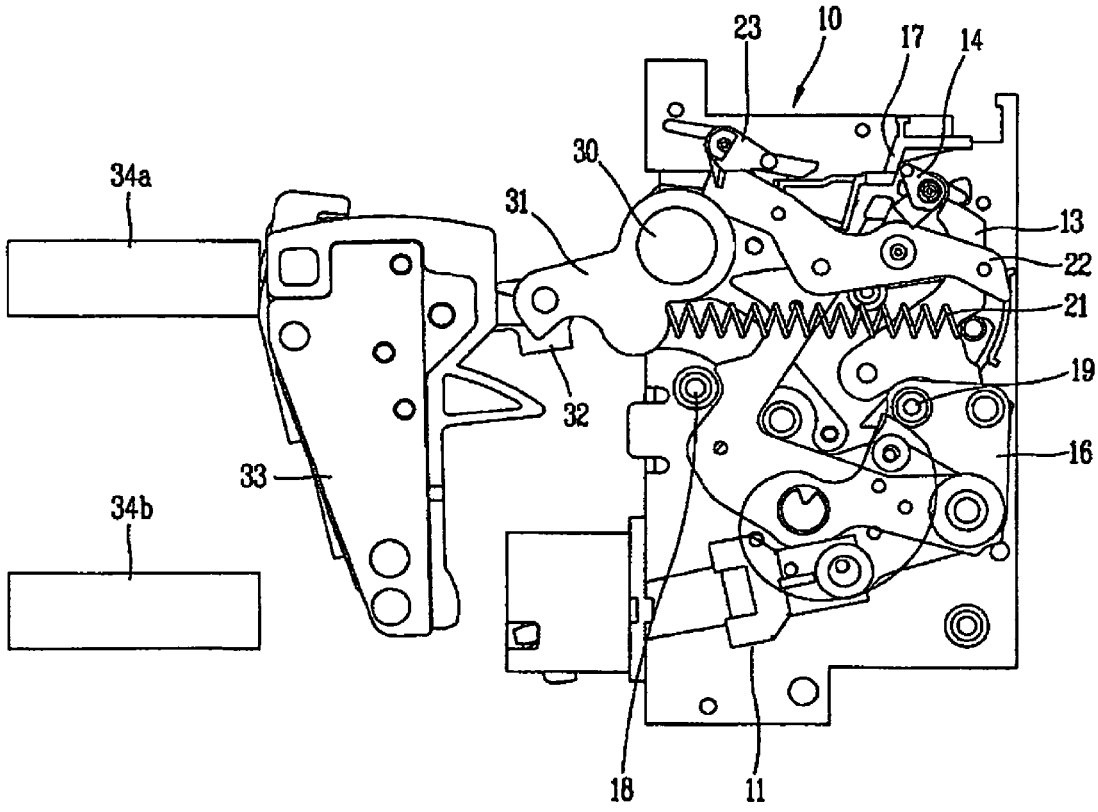
FIG. 4 is a state view showing that the general air circuit breaker is closed and the closing spring is elastically charged.
Figure 5:
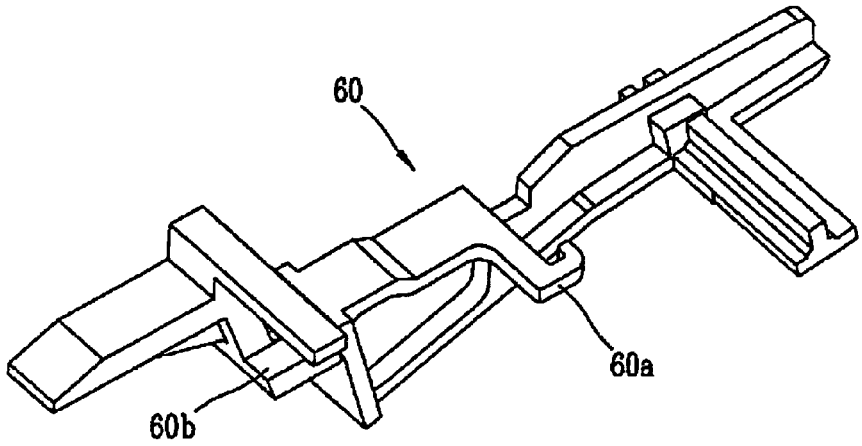
FIG. 5 is a perspective view entirely showing an appearance of an on coupling of an air circuit breaker in accordance with the related art.
Figure 6:
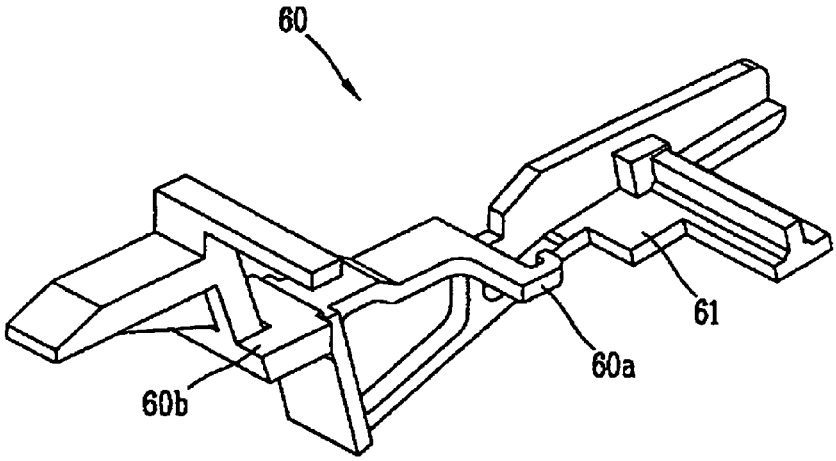
FIG. 6 is a perspective view entirely showing an appearance of an on coupling as a main component of an apparatus for indicating a closing operable state for an air circuit breaker in accordance with the present invention.

When the air circuit breaker is opened and the closing spring charges elastic energy as shown in FIGS. 4 and 9, the on coupling (refer to the reference numeral 17 in FIG. 4, and the reference numeral 60 in FIG. 10) is located at a position where it comes into contact with the on lever 14. Accordingly, the switch operation part 61 of the on coupling 60 presses the lever 71 of the micro switch 72, for operating the micro switch 72, thereby, separating or contacting the contactors (not shown) in the micro switch 72. Thus, the micro switch 72 generates a closing operable signal indicating that the air circuit breaker is in the closing operable state. The closing operable signal is transmitted to the remote place or the door (manipulating and displaying portion at the front surface) of the power distributing cage, which makes a lamp, a buzzer, etc. be driven, for example. Accordingly, it is capable of informing the user that the air circuit breaker is in the closing operable state.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for indicating a closing operable state for an air circuit breaker, the apparatus comprising:

a micro switch installed at a switching mechanism providing a driving force for switching contactors, provided with a lever extended into the switching mechanism so as to receive the driving force, generating and outputting an electric signal for indicating that the air circuit breaker is in a closing operable state, and provided with a signal transmitting terminal for transmitting the electric signal to a remote place; and an on coupling that presses the lever of the micro switch so that the micro switch generates and outputs the electric signal only when a closing spring for providing elastic energy for switching the contactors charges elastic energy and the air circuit breaker is opened, the on coupling having a switch operation part that protrudes from a vertical surface of the on coupling, wherein an edge of the switch operation part faces and is configured to press the lever of the micro switch.

2. The apparatus of claim 1, further comprises a switch case formed by an electrically insulating material and mounting the micro switch therein, wherein the switch case comprises:

a case main body having one opened surface, mounting the micro switch therein and fixable to the switching mechanism; and a door by which the opened surface of the case main body can be opened or closed.

3. The apparatus of claim 2, wherein the switch case further comprises a locking mechanism at the door and the case main body corresponding to the door so as to maintain the door in the closed state.

4. The apparatus of claim 3, wherein the locking mechanism comprises locking protrusions and a locking groove or locking openings into which the locking protrusions are inserted, wherein the locking protrusions are disposed at the door and the locking groove or the locking openings are disposed at the case main body, and vice versa.

5. The apparatus of claim 2, wherein the door and the case main body is connected to each other by a chamfer having a thickness thinner than other portion of the switch case and serving as a hinge portion for rotatably opening or closing the door.

6. The apparatus of claim 2, wherein the case main body comprises:

a fixing protrusion for insertion downwardly extended from a lower surface of the case main body; and a screw fixing protrusion horizontally extended from the lower side of the case main body, so as to fix the switch case to the switching mechanism.

7. The apparatus of claim 2, wherein the case main body comprises:

an opening wall that allows the lever of the micro switch to be outwardly protruded even when the door is closed; and an opening wall for introducing a signal wire allowing the signal wire connected to signal transmitting terminal of the micro switch to be introduced thereinto.

8. An air circuit breaker having an apparatus for indicating a closing operable state, comprising a stationary contactor connected to a circuit, a movable contactor that can be moved to a closing position for conducting the circuit by coming into contact with the stationary contactor or an opening position for disconnecting the circuit by being separated from the stationary contactor, a closing spring providing a driving force for moving the movable contactor to the closing position when discharging charged elastic energy, a switching mechanism transmitting the discharging energy of the closing spring to the movable contactor, a closing latch that can be moved to a locking position for locking the switching mechanism so as to maintain the closing spring in the elastically charged state or a releasing position for releasing the switching mechanism so as to discharge the charged elastic energy, an on lever rotationally driven by coming into contact with the closing latch so as to move the closing latch to the releasing position, a closing button for manually instructing a closing operation, and an on coupling driven by coming into contact with the closing button so as to rotate the on lever, wherein the apparatus for indicating the closing operable state comprises a micro switch installed on a moving path of the on coupling moving to a position where it comes into contact with the on lever and indicating that the air circuit breaker is in the closing operable state with a lever of the micro switch coming into contact with the on coupling moving to the position where it comes into contact with the on lever when the closing spring charges elastic energy and the movable contactor is opened, and the on coupling having a switch operation part that protrudes from a vertical surface of the on coupling, wherein an edge of the switch operation part faces and is configured to press the lever of the micro switch, the switch operation part being provided on the on coupling so as to allow the lever of the micro switch to be pressed so that the micro switch generates and outputs an electric signal when the closing spring charges elastic energy and the movable contactor is opened.

9. The air circuit breaker of claim 8, wherein the switch operation part protrudes at a pressed distance of the lever of the micro switch long enough to operate the micro switch.

10. The air circuit breaker of claim 8, further comprises a switch case installed on a top plate of the switching mechanism by being formed by an electric insulating material, mounting the micro switch therein and provided with the door that can be opened or closed.

* * * * *